US005109913A

United States Patent [19]

Kazuma

[11] Patent Number: 5,109,913

[45] Date of Patent: May 5, 1992

[54] METHOD OF OPENING AND CLOSING STRIP CURTAIN AND APPARATUS THEREFOR

[76] Inventor: Kuniharu Kazuma, 32-banchi, Dai 95-go, Ayukawa-cho, Fukui-shi, Fukui-ken, Japan

[21] Appl. No.: 570,086

[22] Filed: Aug. 20, 1990

[30] Foreign Application Priority Data

Aug. 18, 1989 [JP] Japan ..... 1-213166
Jul. 5, 1990 [JP] Japan ..... 2-71591[U]

[51] Int. Cl.[5] ..... A47H 1/00
[52] U.S. Cl. ..... 160/332; 160/341
[58] Field of Search ..... 160/332, 340, 341, 184

[56] References Cited

U.S. PATENT DOCUMENTS 534,828 2/1895 Hensel ..... 160/332
3,982,581 9/1976 Madsen ..... 160/340
4,719,957 1/1988 Strelnieks ..... 160/332
4,858,668 8/1989 Toti ..... 160/330 X

FOREIGN PATENT DOCUMENTS 487540 10/1950 Canada ..... 160/341

*Primary Examiner*—Carl D. Friedman
*Assistant Examiner*—Korie H. Chan
*Attorney, Agent, or Firm*—Edwin E. Greigg; Ronald E. Greigg

[57] ABSTRACT

A method and apparatus for opening and closing a strip curtain which comprises a plurality of parallel, long hanging strips arranged and vertically. A connecting member for connecting to one end of the hanging strips 7, a plurality of equally spaced operating members arranged at the connected end of the strip curtain and interposed among the hanging strips 7, each operating member is swingably attached to the connecting member for swinging or tiltable in a direction of alignment of the hanging strips 7, and operating connection means for opening and closing the strip curtain.

10 Claims, 11 Drawing Sheets

METHOD OF OPENING AND CLOSING STRIP CURTAIN AND APPARATUS THEREFOR

BACKGROUND OF THE INVENTION

1. Field of the Invention

The present invention relates to a method of opening and closing a strip curtain and an apparatus therefor which enables one to freely control light penetration conditions through the strip curtain with a simple operation.

2. Description of the Prior Art

A conventional curtain provided with a window ordinarily controls the desired quantity of light according to its material or the thickness thereof to prevent light penetration from the outside. Such a curtain, however, could not completely prevent light penetration through a portion thereof when the curtain is closed.

A method of partly changing the quantity of light passing through the curtain, has been proposed by Japanese Utility Model Publication 50-19313. The method set forth by the curtain of the publication (shown in FIG. 12) comprises the steps of forming insertion spaces (a) by bending a portion of the curtain cloth at predetermined intervals, forming shade plate portions (c) by inserting a plate (b) into the insertion space (a) respectively, and then changing the inclinations of the shade plate portions (c) in the same manner as in a conventional blind. The curtain having such a construction neither partly forms a complete light penetrating portion, nor provides a soft appearance of the curtain. As the result, the curtain becomes unnatural in appearance.

SUMMARY OF THE INVENTION

The method and apparatus of this invention provides a curtain which is formed with complete light penetrating portions without bringing about unnatural appearance of the curtain. As the result, the inventor has provided a strip curtain in which a plurality of parallel hanging strips are connected at their upper ends thereof, which are gathered into predetermined bunches to form an opening among the bunches of the hanging strips, or which maybe gathered at one end in a bunch.

An object of the present invention is to provide a simple method of opening and closing a strip curtain.

The strip curtain includes long hanging strips each of which have a flexible upper portion connected by a connecting member at the upper end thereof. A plurality of the hanging strips are gathered at their flexible portions to form a bunch including equal numbers of the hanging strips, so that when the bunches are moved to form an opening among the bunches of hanging strips adjacent one another, light can shine through the openings. When the bunches are released the strip curtain returns to its closed position.

Another object of the present invention is to provide an opening and closing apparatus for a strip curtain.

The opening and closing apparatus comprises a plurality of long hanging strips arranged parallel and vertically and having a flexible portion at least at the upper portion thereof respectively, a connecting member for connecting the hanging strips at the upper portions thereof to form a strip curtain, a plurality of operating members arranged at an end of the strip curtain and interposed among the hanging strips having an interval of a predetermined distance therebetween, each said operating member being provided with projections that project from the front side and the reverse side of the strip curtain and are provided with a hanging portion, each said operating member being attached to the connecting member at the upper portion thereof in such a manner that the operating member is swingable or tiltable in the direction of alignment of the hanging strips, and operating connection means for connecting tip ends of the front projections of the operating members to one another and also tip ends of the reverse projections of the operating members to one another.

In the function of the apparatus, when the operating connection means is moved in a direction of the outward end of the strip curtain, the hanging strips 7 are guided by guide frame portions, which are formed by the operating members and the operating connection means. Then the strips are moved laterally to be gathered to form separate bunches, and an opening is formed respectively among the bunches of the hanging strips when they are gathered to form adjacent bunches. When the operating connection means is returned to its original position, each of the bunches of the hanging strips becomes free from the operating members and hang so as to bring about a closed state of the strip curtain.

As is clear from the above description, the present invention has advantages of easily and freely forming complete light penetrating portions partly with the strip curtain in the closed state while maintaining a soft appearance of the curtain. Further, by forming the partial complete light penetrating portions, a unique variation may appear in the strip curtain contrary to the conventional curtain or blind and therefore fashionable needs in the field of interior designs nowadays may be satisfied with the present invention.

Further, since the apparatus of this invention is simple and compact in construction, it is superior and advantageous in operation and where the apparatus is combined with the strip curtain, it does not lose the soft appearance of the strip curtain, or rather constitutes a part of the strip curtain in curtain designs.

Other advantages of the present invention will be apparent from the description of the embodiments accompanying the drawings.

BRIEF DESCRIPTION OF THE DRAWINGS

The drawings show embodiments of an opening and closing apparatus for a strip curtain according to the present invention in which.

DETAILED DESCRIPTION OF THE EMBODIMENT

Figure 1:
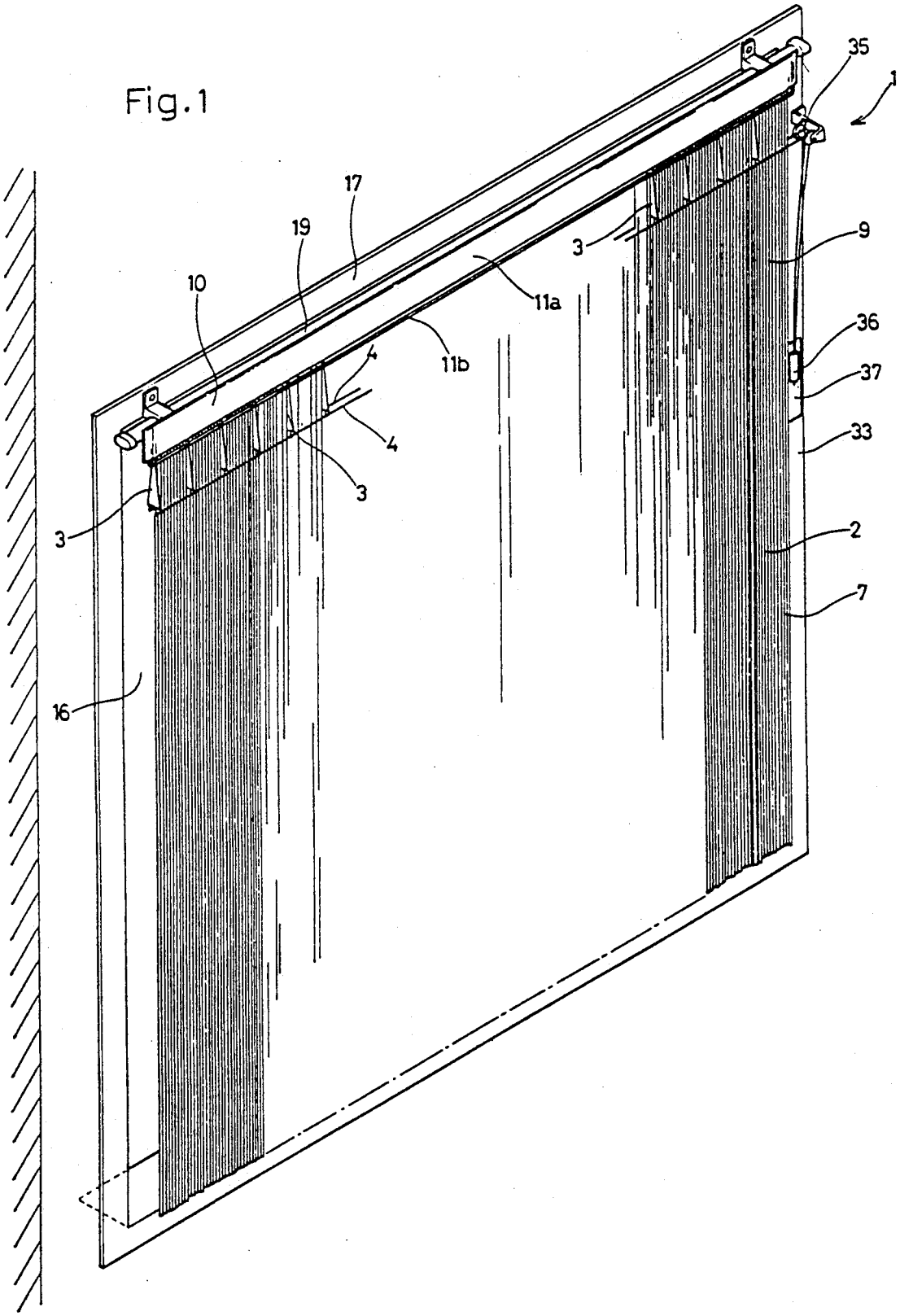
FIGS. 1 and 2 are perspective views of the apparatus.
Figure 2:
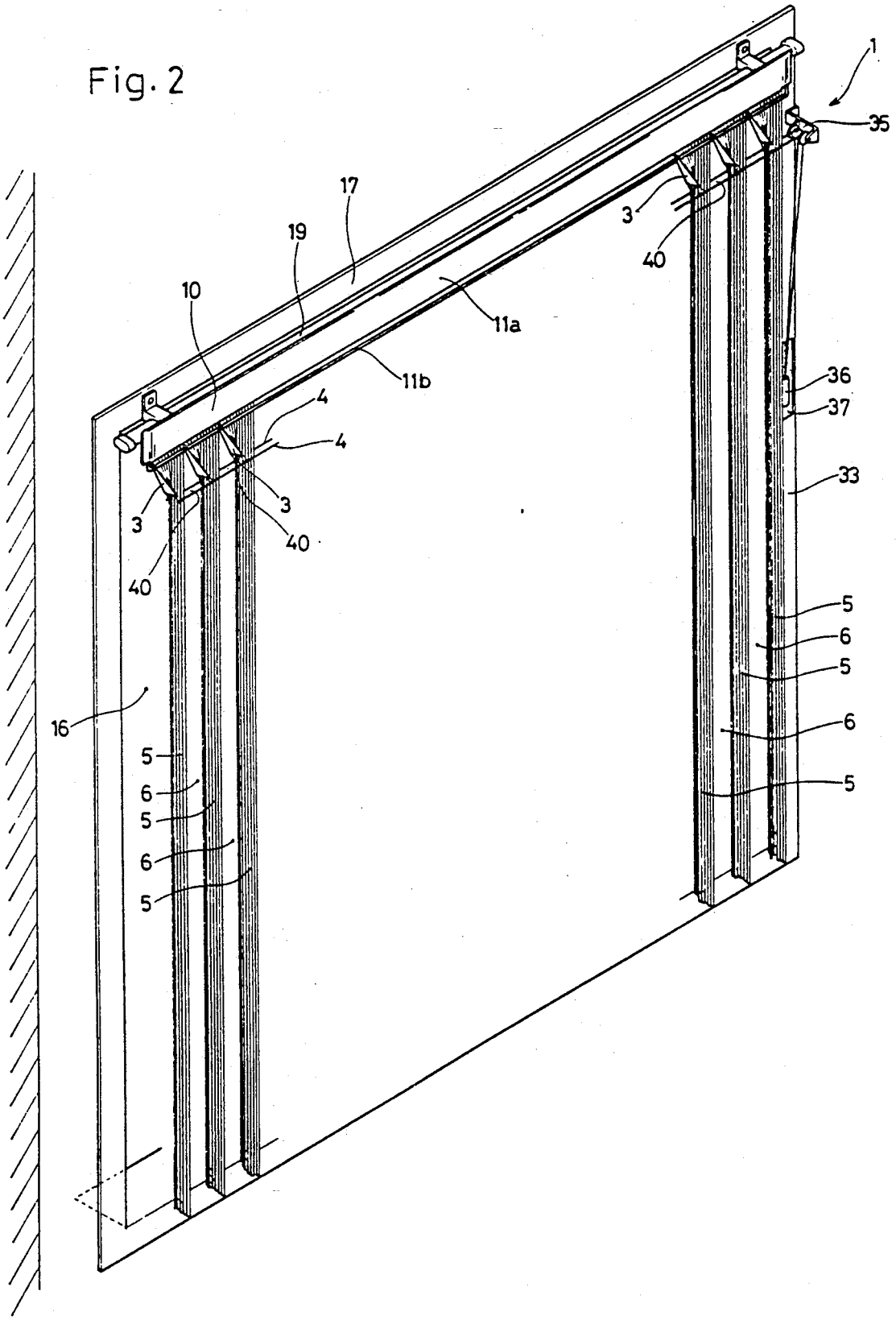
Figure 3:
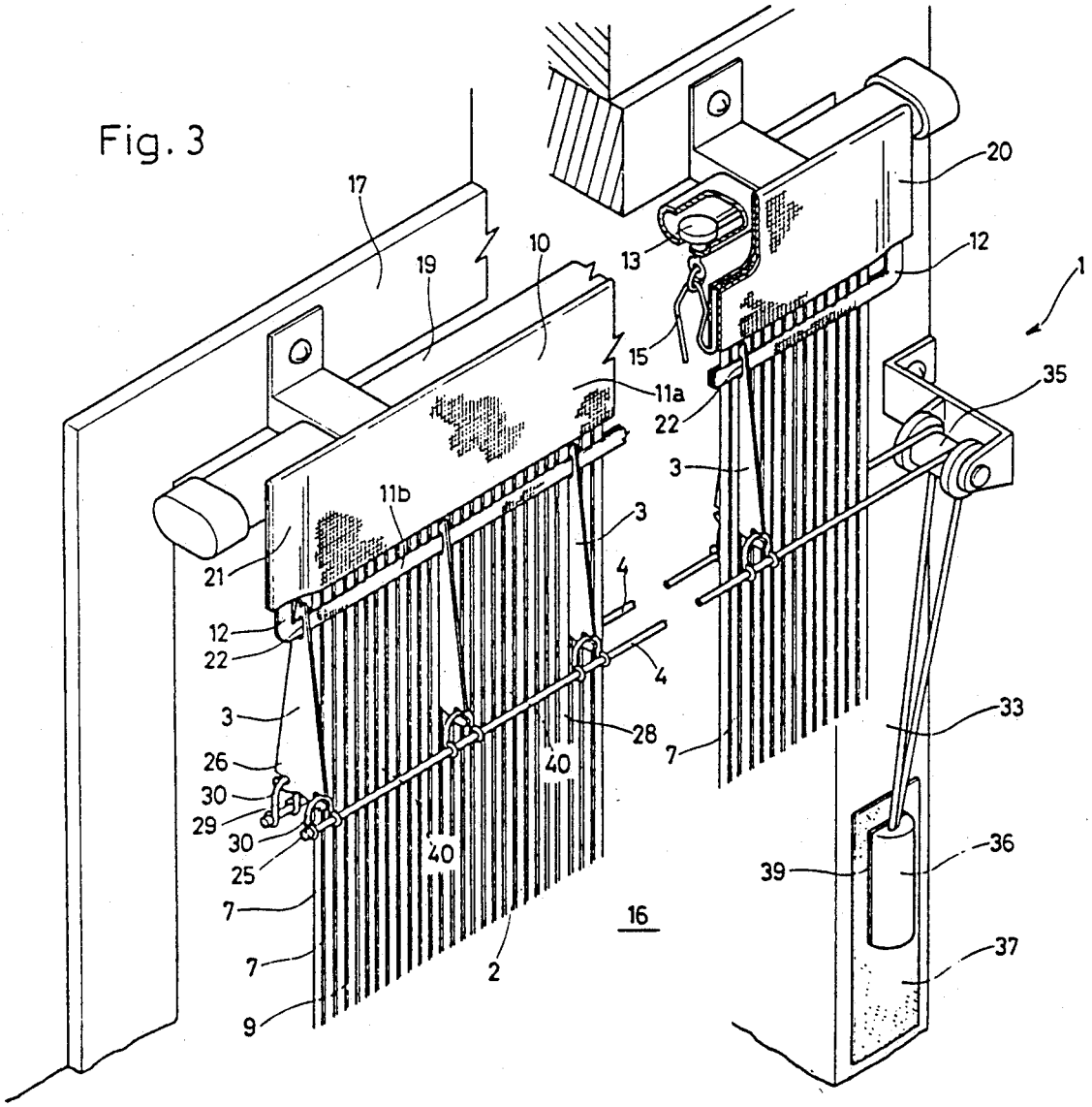
FIGS. 3 and 4 are enlarged perspective views of essential portions of the apparatus.
Figure 4:
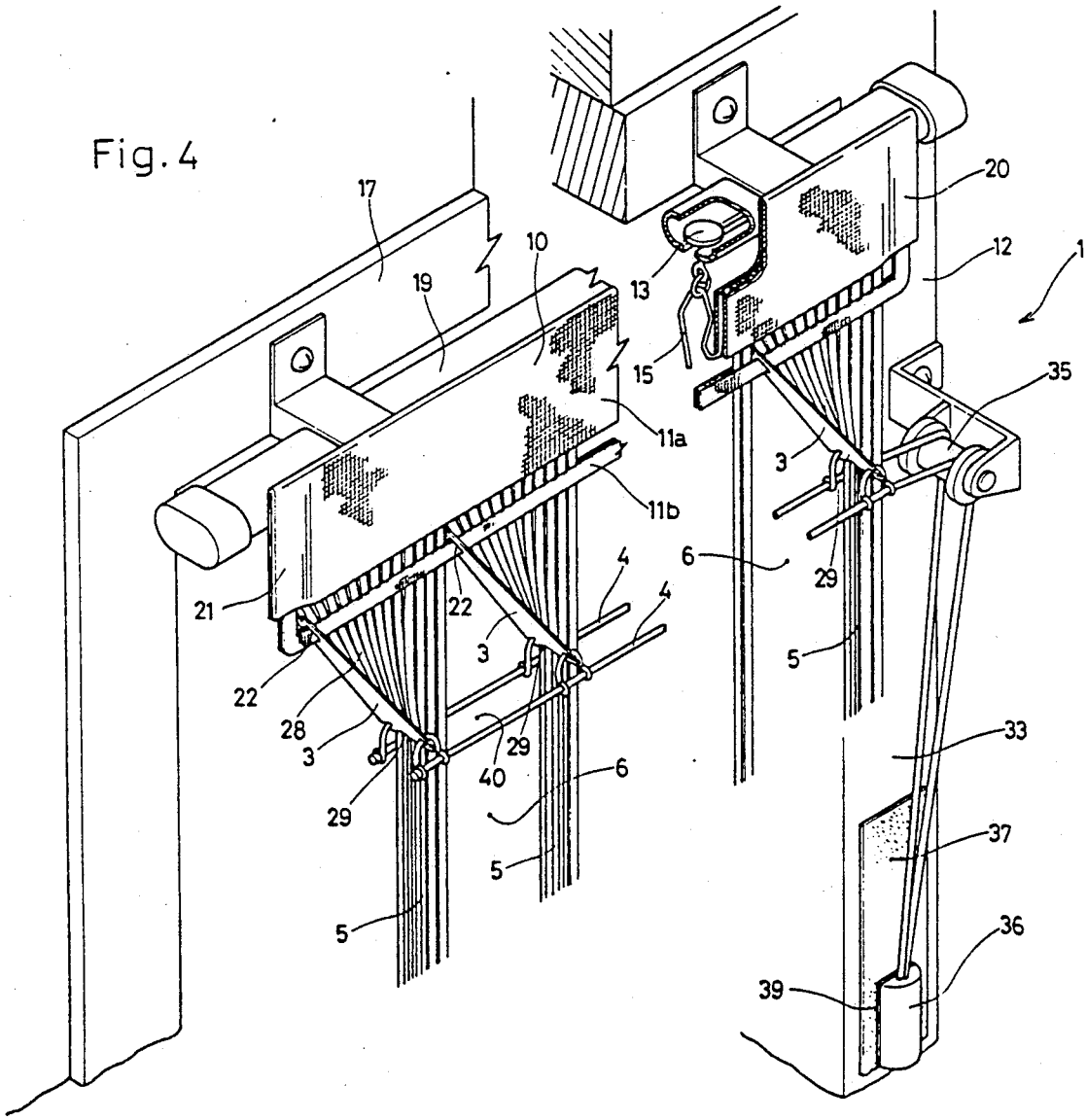

As shown in FIGS. 1 through 4, an opening and closing apparatus for a strip curtain 1 according to the present invention is so constructed that a number of hanging strips 7 which form a strip curtain 2 are separated into predetermined numbers as a bunch 5, and the separated hanging strips 7 may be gathered at their adjacent upper end portions thereof via a plurality of operating members 3, each of which are connected together by an operating connection member 4. When the hanging strips 7 are gathered together as shown in FIGS. 2 and 4, openings, 6 as complete light penetrating portions of the strip curtain 2 are formed respectively among each of the bunches 5 of the hanging strips.

The strip curtain 2 comprises the hanging strips 7, presented as a tape or a band (in the drawings), which strips are arranged in parallel lateral directions 9 and connected to one another at the upper ends thereof by means of a connecting member 10. The connecting member 10 in this embodiment comprises a flexible tape 11*a* for connecting the parallel strips together and a flexible holding member 11*b* in the shape of a band for connecting the parallel strips beneath the flexible tape 11*a*. Both ends 12 and 12 of the holding member 11*b* are made to slightly project from each of the ends of the parallel strips 7 and are then connected to each of the ends of the tape 11*a*.

The strip curtain 2 is mounted onto a curtain rail 19, which is fixed to an upper frame 17 of a window 16, by means of suspenders 13 and hooks 15 in the same manner as a conventional curtain. An end 20 of the upper edge of the strip curtain 2 is always fixed to the curtain rail 19 and another end 21 thereof is detachably attached. The total numbers of the hanging strips 7 of the strip curtain 2 are set to be a multiple of the gathered numbers of the hanging strips 7 as a bunch. The operating members 3 are attached to the connecting member 10 near an upper end of the strip curtain 2 and spaced predetermined distances between a like number of hanging strips 7.

Figure 5:
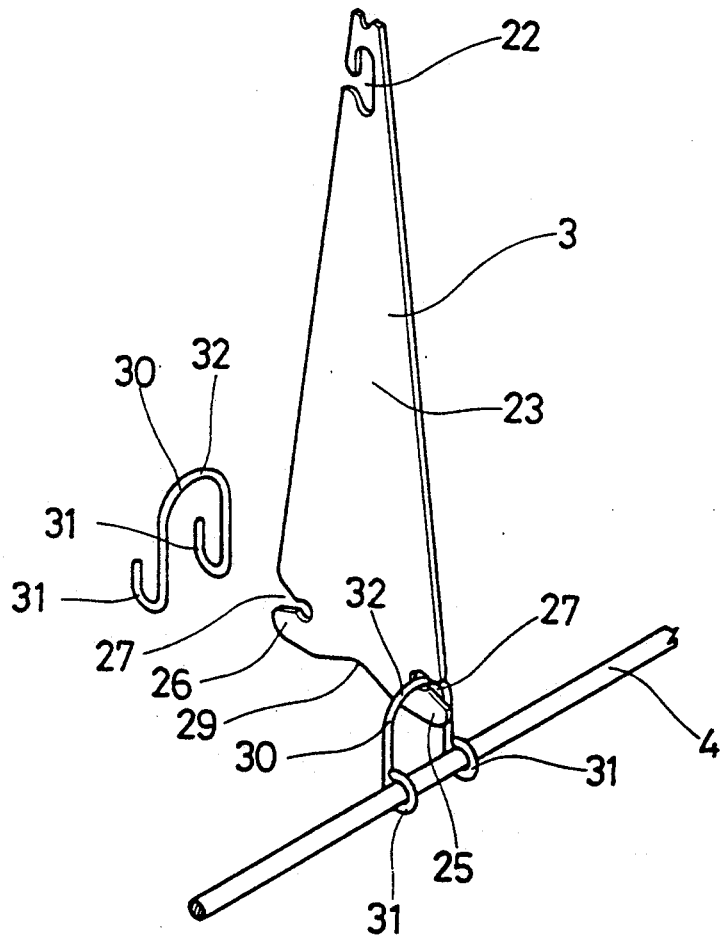
FIG. 5 is a perspective view of an operating member and operating connection members.

As shown in FIGS. 3 through 5, each of the operating members 3 in this embodiment provides a hook end portion 22 at the upper end thereof which hook portion is secured onto the holding member 11*b*, and a hanging portion 23 which is provided with end projections 25 and 26 which project from a front side and a reverse side of the strip curtain 2, respectively. The operating member 3 is made of transparent plastic in the form of an isosceles triangle. The hook portion 22 is loosely engaged with the holding member 11*b* so as to be able to smoothly swing or tilt in a direction of alignment of the hanging strips 7 (in lateral directions) such that the hook portion 22 is engaged with the holding member 11*b*. A slit 27 in the shape of a key hole is formed with a tip end portion of each of the projections 25 and 26 for connecting the operating connection member 4 thereto. A lower edge of the operating member 3 is formed with an intermediate concave portion 29 in order to gather the upper flexible end portions 28 of the hanging strips 7.

The operating connection member 4 is made of a flexible string or line which is connected with projections 25 of each of the hangers 3. The member 4 is connected in front of the strip curtain 2, and also connects the reverse projections 26 to each other, which project to the rear of the strip curtain 2. As shown in FIG. 5, the connection is carried out such that both of the lower ends 31 and 31 of a connecting bracket 30 in the shape of an inverted-U and a curved portion 32 of the connecting bracket 30 is fit into the key hole slit 27. The operating connection member 4 which connects the front and reverse projections 25 and 26 of the operating member 3, extends downwardly with one end thereof (the right end thereof in the drawings) in such a state that it is guided by a guide pulley 35 which is rotatably mounted on a side frame of the window located at the right side of the strip curtain 2, and then an operating knob 36 is fixed to the extended lower end thereof. Fixed to the operating knob 36 is a flat fastener 39 extending in up and down directions which fastener 39 is engagable with a flat fixed fastener 37 attached to the side frame 33 of the window.

In a state such that opposite ends of the upper edge of the strip curtain 2 are fixed to opposite ends of the curtain rail 19 and the strip curtain 2 is closed (See FIG. 1), then when the operating knob 36 is pulled downwardly, a predetermined plural number of hanging strips 7, which are positioned in a rectangular guide frame portion 40 formed by the operating members 3 and both sides of the operating connection member 4, are guided by the guide frame portion 40 and move laterally as shown in FIG. 4, according to the movement in a direction toward an end of the operating member 3, and they are gathered at the gathering concave end 29. A bunch 5 of the hanging strips gathered by the gathering concave end 29, move to form openings 6 respectively between them so that light passes through the openings 6. When the flat fastener 39 of the operating knob 36 is engaged with the flat fastener 37 of the side frame 33, the operating knob 36 is fixed to the window 16 so a to hold the strip curtain 2 in its open state (See FIGS. 1 and 4). When the operating knob 36 is released and removed from the side frame 33 and returns to its original position, each of the hanging strips 7 become free from the operating member 3 and are suspended so that the strip curtain 2 is in a closed state (See FIGS. 2 and 3).

The strip curtain 2 may be freely opened and closed by separating the left side end portion 21 of the upper edge of the strip curtain 2 from the curtain rail 19, in such a state that the operating connection member 4 of flexible string is bent and curved smoothly without occurring any stress.

Figure 6:
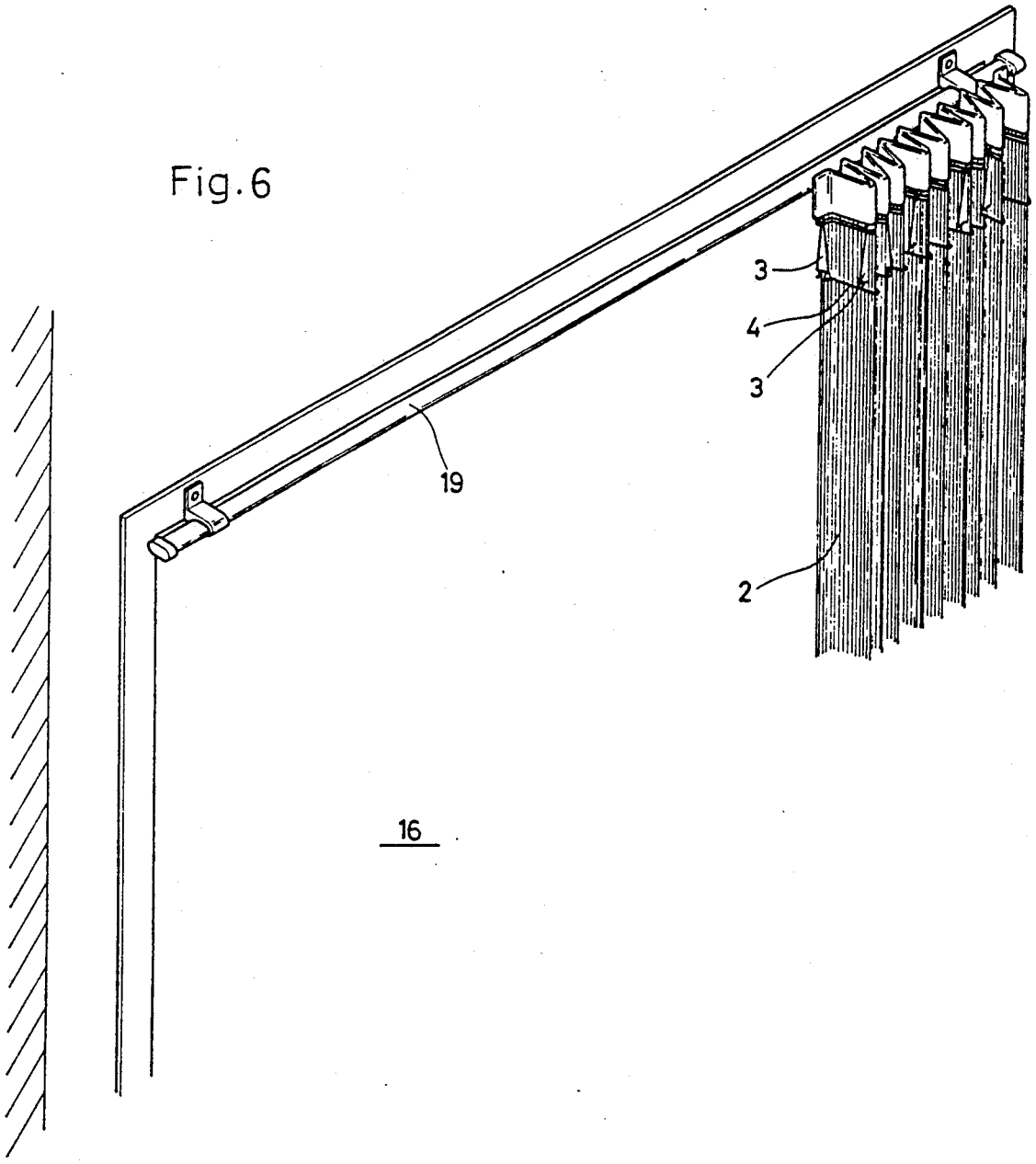
FIG. 6 is a perspective view showing a state of opening a strip curtain.

FIG. 6 shows a state in which the strip curtain 2 is opened wholly.

Figure 7:
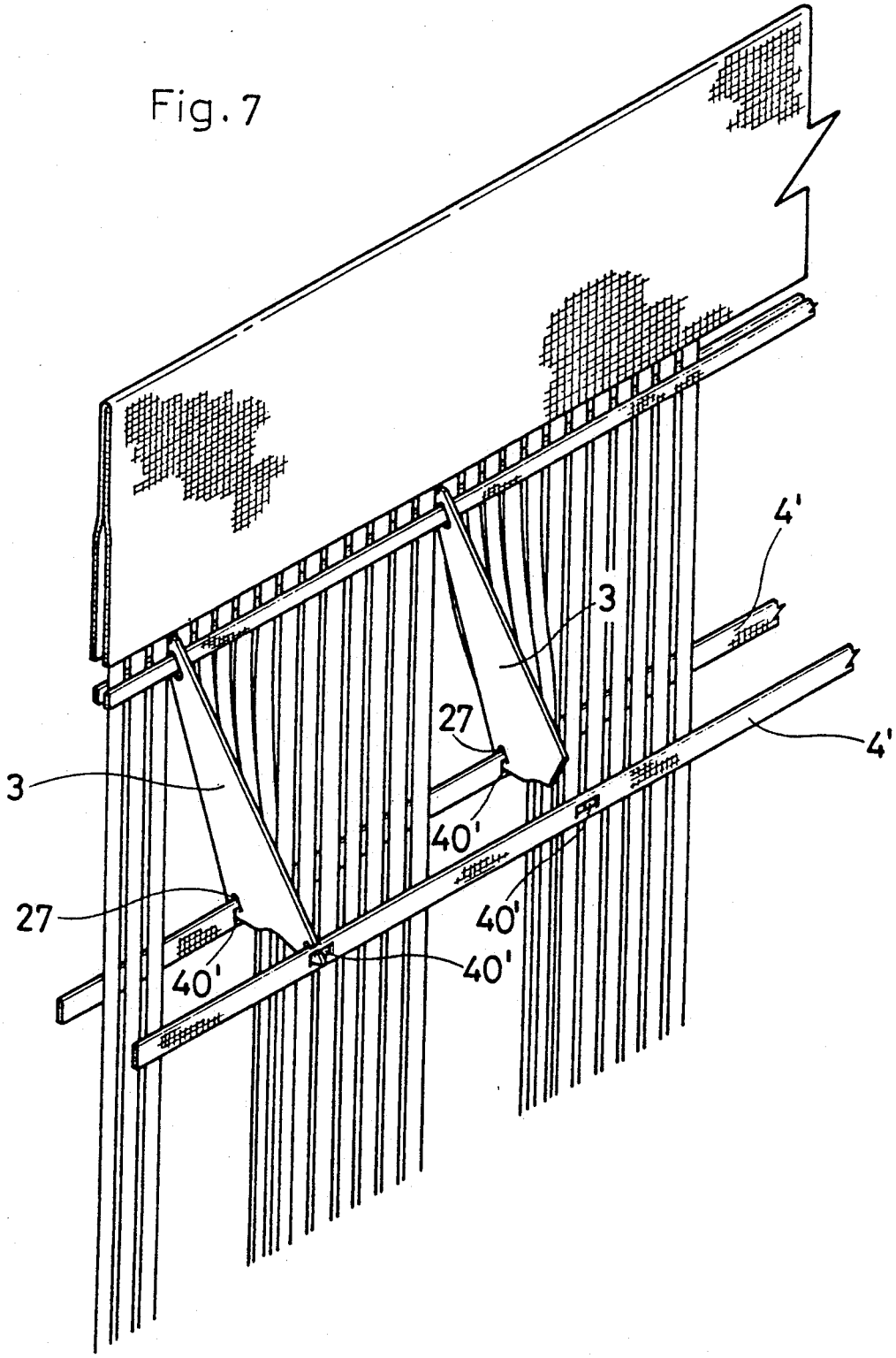
FIG. 7 is a perspective view of a part of the apparatus showing another embodiment of the present invention.

FIG. 7 shows a modified embodiment in which the operating connection member 4 of string used in the above mentioned embodiment is replaced with operating connection members 4' presented in a form of a tape, each of which provides openings 40' arranged in a longitudinal direction thereof to be engaged with the key hole slit 27.

Figure 9:
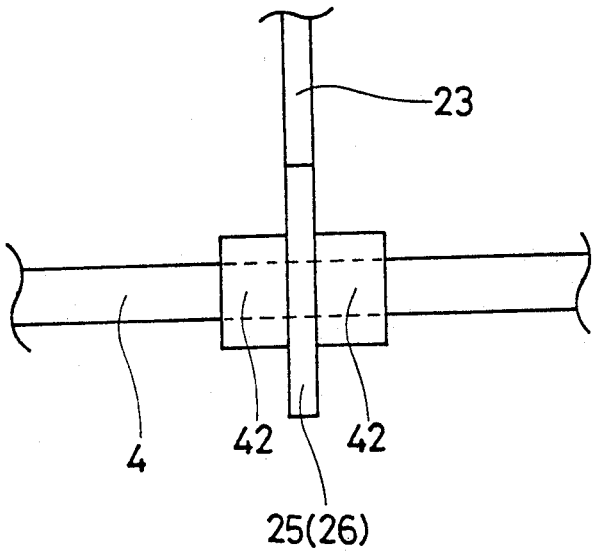
FIG. 9 is a side view showing a state of fixing the operating member to the operating connection member.
Figure 8:
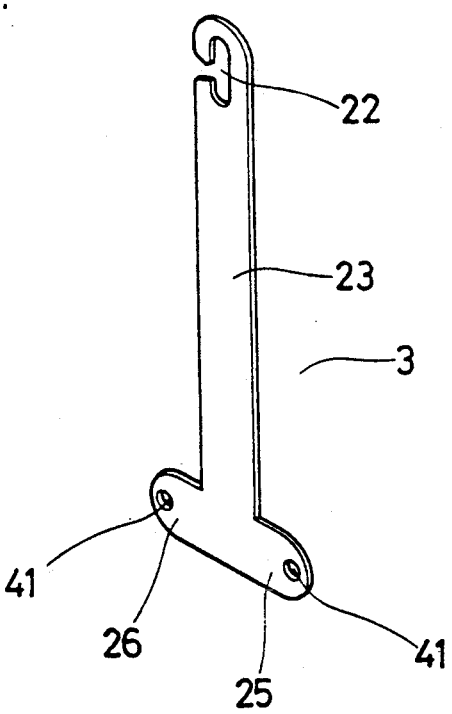
FIG. 8 is a perspective view showing a modified embodiment of the operating member.
Figure 10:
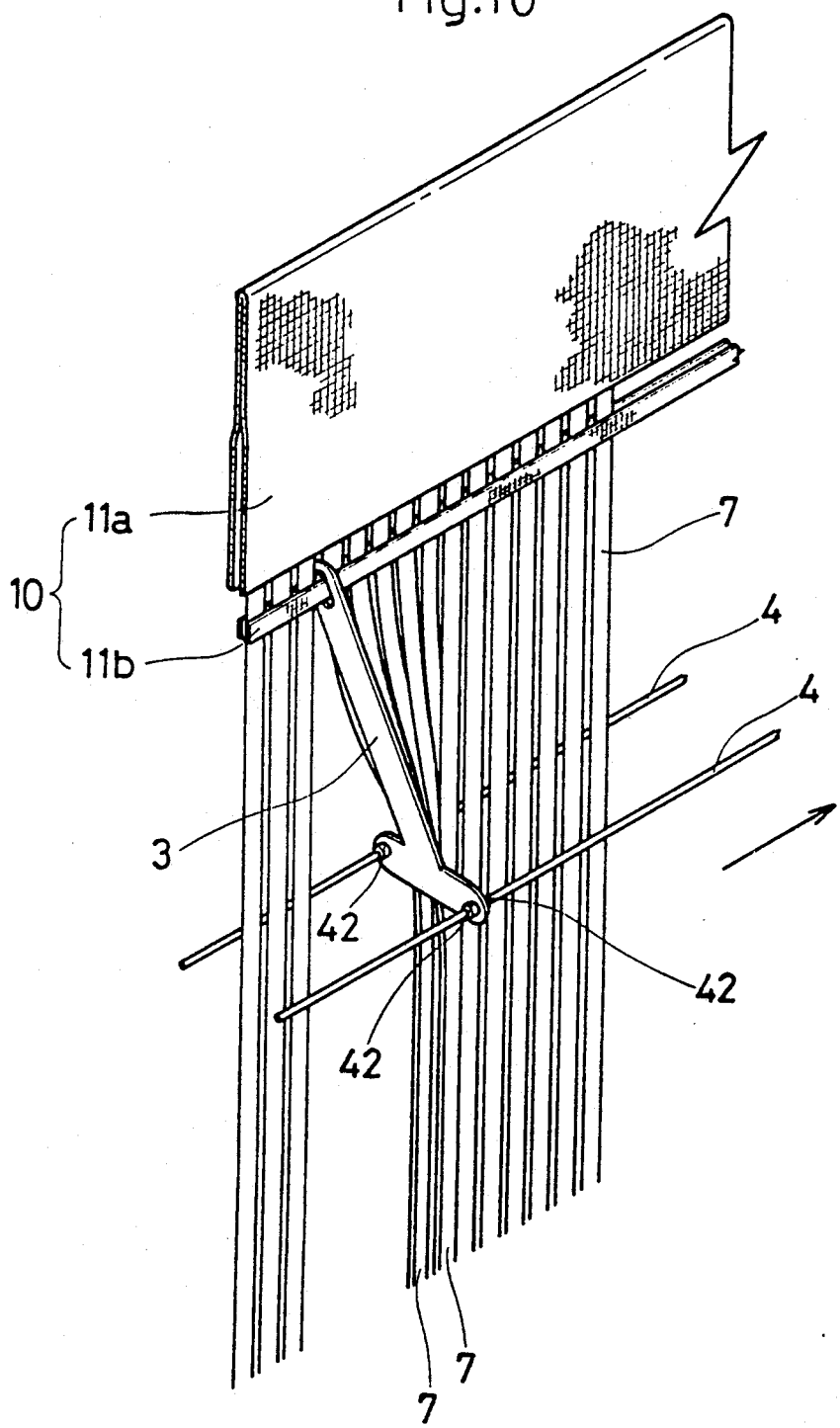
FIG. 10 is a perspective view showing a state of gathering handing strips by means of the operating member of FIG. 8.

FIGS. 8 through 10 shows a modified operating member 3'. The operating member 3' is formed to be an inverted-T and an upper hook portion 22 of hanging portion 23' thereof is engaged with the holding member 11*b* in such a manner that the operating member 3' may swing or tilt in a direction of alignment of the hanging strips 7. Both of the projections 25' and 26' projecting from the lower end portion of the operating member 3', provide an insertion opening 41 respectively for inserting therethrough the operating connection member 4.

Fixing members 42 and 42 are fixed to the operating connection member 4 in the state of insertion, so as to sandwich the projections 25' and 26' from both of the sides thereof, as shown in FIGS. 9 and 10. Therefore, as shown in FIG. 10, when the operating connection member 4 is moved outwardly of the strip curtain 2 (in the direction of an arrow), the hanging strips 7 are gathered according to the swing or tilting actions of the operating member 3, as is mentioned in the first embodiment.

Figure 11:
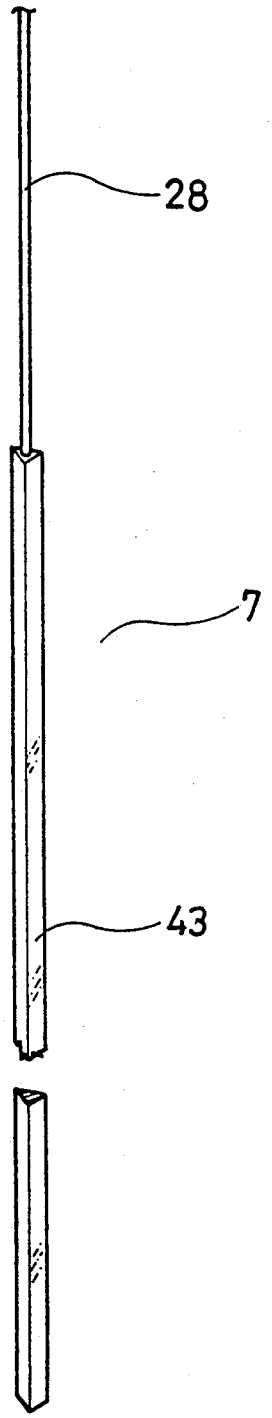
FIG. 11 is a perspective view showing another modified example of the handing strips.
Figure 12:
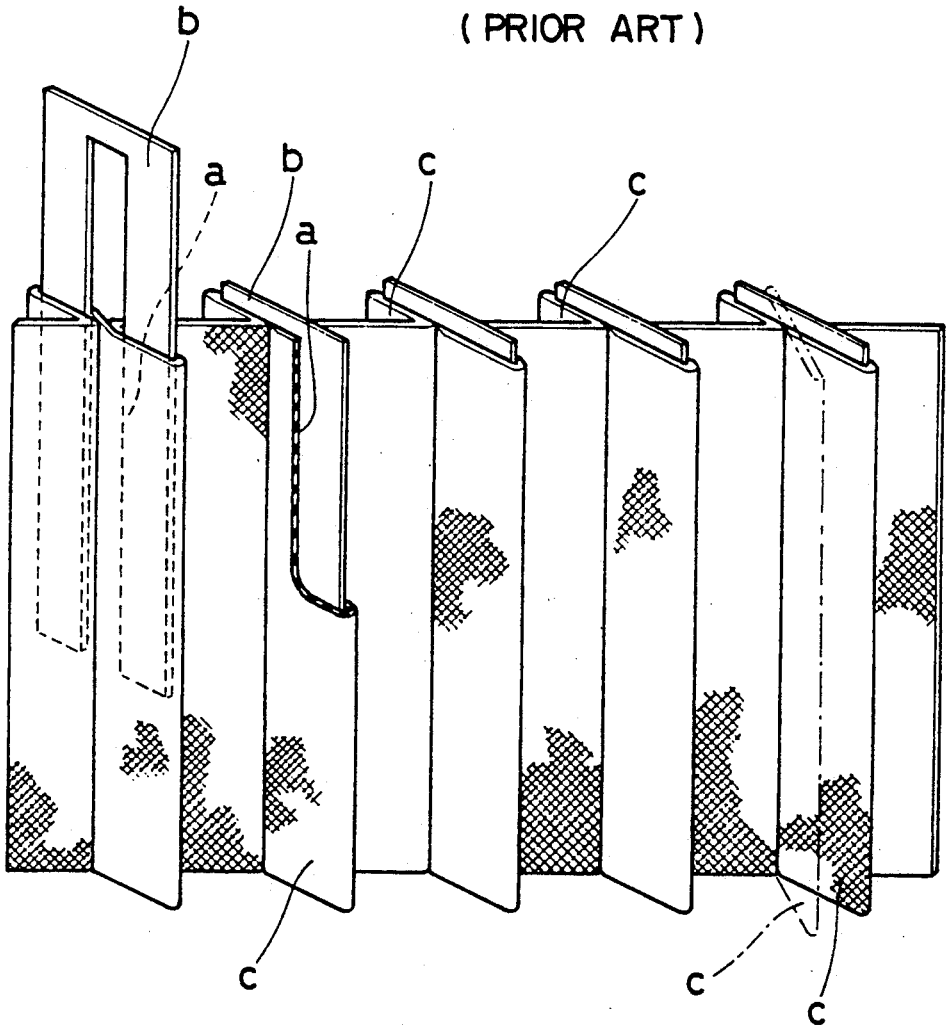
Fig.12 (PRIOR ART)
FIG. 12 is a perspective view showing a conventional blind curtain.

FIG. 11 shows a modified hanging strip 7 which comprises a rigid, long and triangular prism portion 43 and a flexible portion 28, which is connected by a lower end to the upper portion of the triangular prism 43. The hanging strips 7 are gathered at the flexible portion 28 with swing or tilting action of the operating member 3 or 3', as mentioned in the fore-mentioned embodiment.

What is claimed is:

1. An opening and closing apparatus for a strip curtain comprising:

a plurality of parallel, elongated hanging strips (7) arranged vertically, each of said strips having a flexible portion at least at an upper portion of said hanging strips, a connecting member (10) for connecting the hanging strips (7) at the upper portion of said hanging strips to form a strip curtain having a front side and a reverse side, a plurality of rigid operating members (3, 3') arranged at an upper end portion of the strip curtain (2) and interposed among the hanging strips (7) having an interval of a predetermined distance with a predetermined number of strips therebetween, each said operating member (3, 3') being provided with a hanging portion (23, 23') with a lower end of each said operating member including front projections (25, 25') and reverse projections (26, 26') which project from said front side and said reverse side of the strip curtain (2), said connecting member (10) including a holding means (**11*b*), each said operating member (3, 3') being attached at their upper end portion to said holding means in such a manner that the operating member (3, 3') is swingable or tiltable in a direction of alignment of the hanging strips (7), and operating connection means (4, 4') for connecting tip ends of the front projections (25, 25') of the operating members (3, 3') to one another and also tip ends of the reverse projections (26, 26') of the operating members (3, 3'**) to one another.

2. An opening and closing apparatus for a strip curtain as claimed in claim 1, wherein the operating members (3, 3') are made of transparent plastic to form an isosceles triangle and includes a hanging portion (23, 23'), a hook portion (2) to be hooked by said holding means (**11*b*) of said connecting member (10), front and reverse slits (27) in said front projections (25, 25') and said reverse projections (26, 26'**).

3. An opening and closing apparatus for a strip curtain as claimed in claim 2, further comprising:

a rotatable guide pulley (35) mounted on a window frame (33) located adjacent an end of the strip curtain (2) for guiding the operating connection means (4), an operating knob (36) connected to a lower end of the operating connection means (4), a first flat fastener (39) fixed to the operating knob (36), and a second flat fastener (37) attached to the window frame (33) to engage with said first flat fastener (39).

4. An opening and closing apparatus for a strip curtain as claimed in claim 3, wherein the hanging strip (7) comprises a rigid, long and triangular prism portion (43) and a flexible portion (28), a lower portion of said flexible portion is connected to an upper portion of the triangular prism portion (43).

5. An opening and closing apparatus for a strip curtain as claimed in claim 1, wherein the operating member (3') is made to form an inverted-T and includes a hanging portion (23'), a hook portion (22) to be hooked by the holding means (**11*b*), front and reverse projections (25') and (26') having an insertion opening (41**), respectively.

6. An opening and closing apparatus for a strip curtain as claimed in claim 5, wherein the hanging strip (7) comprises a rigid, long and triangular prism portion (43) and a flexible portion (28), a lower portion of said flexible portion is connected to an upper portion of the triangular prism portion (43).

7. An opening and closing apparatus for a strip curtain comprising:

a plurality of elongated hanging strips (7) arranged vertically, each of said elongated hanging strips having a flexible portion at least at an upper portion of said hanging strips, a connecting member (10) which comprises flexible tape means (**11*a*) and holding means (11*b*) for connecting said elongated hanging strips (7) beneath said tape means (11*a*) for connecting the hanging strips (7) at the upper portion of said hanging strips to form a strip curtain having a front side and a reverse side, a plurality of operating members (3) arranged at an upper end portion of the strip curtain (2) and interposed among the hanging strips (7) having an interval of a predetermined distance with a predetermined number of strips therebetween, each said operating member (3) being provided with front projections (25) and reverse projections (26) projecting from said front side and said reverse side of the strip curtain (2), each said operating member (3) being attached at their upper ends to said holding means of said connecting member (10) in such a manner that the operating member (3) is swingable or tiltable in a direction of alignment of the elongated hanging strips (7), and operating connecting means (4, 4') for connecting tip ends of the front projections (25) of the operating members (3) to one another and also tip ends of the reverse projections (26) of the operating members (3**) to one another.

8. An opening and closing apparatus for a strip curtain as claimed in claim 7, wherein the operating connection means (4) is made of flexible string.

9. An opening and closing apparatus for a strip curtain as claimed in claim 7, wherein the operating connection means (4') is made of a tape.

10. An opening and closing apparatus for a strip curtain as claimed in claim 9, wherein the hanging strip (7) comprises a rigid, long and triangular prism portion (43) and a flexible portion (28), a lower portion of said flexible portion (28) is connected to an upper portion of the triangular prism portion (43).

* * * * *